US006109779A

United States Patent [19]

Weinekötter et al.

[11] Patent Number: 6,109,779

[45] Date of Patent: Aug. 29, 2000

[54] CONTINUOUS MIXER, MIXING INSTALLATION HAVING A CONTINUOUS MIXER AND METHOD OF OPERATING SUCH A MIXING INSTALLATION

[75] Inventors: Ralf Weinekötter, Zürich; Lukas Hiltbrunner, Wiesendangen, both of Switzerland

[73] Assignee: Gericke AG, Regensdorf, Switzerland

[21] Appl. No.: 09/236,456

[22] Filed: Jan. 25, 1999

[30] Foreign Application Priority Data

Feb. 4, 1998 [CH] Switzerland ..... 269/98

[51] Int. Cl.[7] ..... B01F 15/02

[52] U.S. Cl. ..... 366/193; 366/192; 366/184; 366/141

[58] Field of Search ..... 366/192, 193, 366/141, 184, 601, 132–153.1; 222/294, 55, 64, 56, 52

[56] References Cited

U.S. PATENT DOCUMENTS

| | | | |
|---|---|---|---|
| 1,500,061 | 7/1924 | Dimm | 366/193 |
| 3,174,651 | 3/1965 | Strite | 222/294 |
| 3,419,250 | 12/1968 | Brennen, Jr. | 366/193 |
| 3,515,374 | 6/1970 | Curley | 366/193 |
| 4,205,919 | 6/1980 | Attwell | 366/193 |
| 4,741,264 | 5/1988 | McPeak | 366/601 |
| 4,911,553 | 3/1990 | Sawada et al. | 366/192 |
| 4,915,506 | 4/1990 | Sato et al. | 366/192 |
| 5,240,324 | 8/1993 | Phillips et al. | 366/141 |

FOREIGN PATENT DOCUMENTS

| | | | |
|---|---|---|---|
| 232305 | 4/1925 | United Kingdom | 366/193 |

*Primary Examiner*—Tony G. Soohoo
*Attorney, Agent, or Firm*—Morgan, Lewis & Bockius LLP

[57] ABSTRACT

A continuous mixer (10) comprises an elongated mixing container (11), which has an inlet opening (14) at one end for feeding in the basic components to be mixed and which encloses a mixing space (12), which merges at the other end into a discharge region (22) for the delivery of the mixed product, and in which mixing container (11) there is arranged a mixing tool (13), which is rotatable about an axis (41), is driven by a drive (18, 40) and mixes together the basic components fed into the inlet opening (14) and at the same time transports them to the discharge region (22). In such a mixer, improved control of the mixing conditions is achieved by an adjustable discharge opening (19) adjustable in size being arranged between the discharge region (22) and the mixing space (12).

16 Claims, 3 Drawing Sheets

CONTINUOUS MIXER, MIXING INSTALLATION HAVING A CONTINUOUS MIXER AND METHOD OF OPERATING SUCH A MIXING INSTALLATION

TECHNICAL FIELD

The present invention relates to the field of mixing technology. It relates to a continous mixer, comprising an elongated mixing container, which has an inlet opening at one end for feeding in the basic components to be mixed and which encloses a mixing space, which merges at the other end into a discharge region for the delivery of the mixed product, and in which mixing container there is arranged a mixing tool, which is rotatable about an axis, is driven by a drive and mixes together the basic components fed into the inlet opening and at the same time transports them to the discharge region. Such a mixer for the mixing of solids and solids with liquids has been produced and sold for some time by the applicant under the type designation GCM (see, for example, the applicant's brochure no. 602).

Furthermore, the invention relates to a mixing installation having a continuous mixer and to a method of operating such a mixing installation.

Continuous mixers of the abovementioned type are used in order to mix different solids or solids with liquids, as used, for example, in the foodstuffs, plastics, pharmaceutical and chemical industries or in construction chemistry. In such mixers, a mixing tool rotating about an axis running in the longitudinal direction is arranged, for example, in an elongated mixing container. At one end of the mixing container, the different basic components to be mixed are fed into the mixer through an inlet opening located at the top side. The mixing tool mixes the components and transports them at the same time to the other end of the mixing container, where the mix is delivered continuously outwards in a discharge region. The discharge region, which is open at the bottom, directly adjoins the mixing container, which is completely open at this end face. On the one hand, the result of this is that the mix can readily be discharged completely from the mixer. On the other hand, the result of this is also that the number of movements of the mix, i.e. how often a certain quantity of the mix is moved by the rotating mixing tool during the retention in the mixing container, cannot be freely selected. This is because, if the rotational speed or rotational frequency of the mixing tool is increased, the number of movements of the mix per unit of time certainly increases. On the other hand, however, the transport velocity of the mix from the inlet to the discharge also increases with the rotational frequency, or the dwell time of the mix in the mixer decreases, so that the total number of movements of the mix does not change at all or only changes slightly.

DESCRIPTION OF THE INVENTION

It is therefore the object of the invention to provide a continuous mixer and a mixing installation equipped with it, which, at a modest design cost and with little outlay in terms of circuitry, permits better setting and control of the mixing conditions, and to specify a method of operating such a mixing installation.

This object is achieved in a mixer of the type mentioned at the beginning in that a discharge opening adjustable in size is arranged between the discharge region and the mixing space. An additional degree of freedom for the setting and control of the mixing conditions is obtained in a simple manner by the adjustable discharge opening. By varying the size of the discharge opening, through which the mix in the mixer leaves, the filling ratio of the mixer and thus the dwell time of the mix in the mixer can be controlled under otherwise constant conditions in the mixer.

A preferred embodiment of the mixer according to the invention is distinguished by the fact that the discharge opening is adjustable during the mixing operation, that the adjustable discharge opening is formed by an adjustable diaphragm, which separates the mixing space from the discharge region, that the adjustable diaphragm comprises a fixed diaphragm part and a diaphragm part adjustable relative thereto, that the fixed diaphragm part and the adjustable diaphragm part are arranged perpendicularly to the axis of the mixing tool, that the adjustable diaphragm part, for the adjustment, is arranged so as to be rotatable about the axis, and that means which enable the adjustable diaphragm part to be adjusted from outside are provided.

The adjustability of the opening during the mixing operation ensures that the size of the opening and thus the filling level and the dwell time can be adapted to mixing conditions varying during the mixing and can be controlled. The forming of the opening by two diaphragm parts adjustable relative to one another is mechanically simple, has low susceptibility to trouble and is easy to clean. The adjustment by rotation about the mixer axis has the advantage that the adjustable opening fits readily into the axial construction of the mixer and can easily be removed together with the mixing tool for cleaning and/or maintenance purposes. Due to the adjustability from outside, the adjusting mechanism and its drive are separate from the mix, so that they cannot have an adverse effect on one another.

The mixing installation according to the invention having the continuous mixer according to the invention is characterized in that a controllable drive is provided for adjusting the adjustable discharge opening, and in that the installation comprises a controller, which activates the drive of the adjustable discharge opening in accordance with one or more input variables. Substantially greater flexibility in the control of the mixing conditions is thereby achieved during the operation of the mixing installation.

A first preferred embodiment of the mixing installation according to the invention is distinguished by the fact that the mixing tool is driven by a drive having variable rotational frequency, and that the controller controls the rotational frequency of the drive. By the rotational frequency and the filling ratio or dwell time being influenced simultaneously, the quality of the resulting mix can be kept constant to a considerable degree even under difficult mixing conditions, such as, for example, highly fluctuating feed conditions for the basic components.

In a preferred development of this embodiment, the drive for the mixing tool comprises a three-phase motor with frequency converter. With this proven drive technology, the rotational frequency can be controlled within wide ranges in a simple and reliable manner.

A second preferred embodiment of the mixing installation according to the invention is characterized in that a rotational-frequency sensor for measuring the rotational frequency of the mixing tool and/or a torque sensor for measuring the torque acting on the mixing tool is provided, and in that the measured values delivered from the sensors are used as input variables for the controller. The mixing operaton can be additionally stabilized by the use of the rotational frequency as control variable. If a torque sensor is used, overload states can be detected in this way and can be reduced by appropriately changing the mixing conditions: on the one hand, this serves as overload protection for the machine. On the other hand, overstressing of the mix in the machine is effectively avoided as a result.

A further preferred embodiment of the mixing installation according to the invention is distinguished by the fact that means for recording the weight of the mix located in the mixer are provided, that the recorded weight is used as input variable for the controller, and that the weight-recording means comprise one or more weighing cells, which are attached to a weight-recording unit and on which the mixer stands. (Indirect) measurement of the filling ratio is made possible by the weight recording, and this measurement may serve as initial information for the control of the filling ratio or the average dwell time.

Further flexibility of the mixing installation is achieved if, in a further preferred embodiment of the invention, means for recording and metering the mass flows of the basic components fed to the mixer are provided, the measured values delivered from the means are used as input variables for the controller, and the controller controls the metering of the basic components.

A method according to the invention of operating a mixing installation according to the invention is characterized in that, during the start-up of the mixing installation, the adjustable opening is first of all kept completely closed, and in that, after a specified set point of one or more input variables is reached, the controller opens the adjustable opening in a controlled manner to a size suitable for the steady operation of the mixing installation.

Another method according to the invention of operating a mixing installation according to the invention, in which the rotational frequency of the mixer is controllable, and the filling of the mixer is monitored via the recording of the weight of the mix located in the mixer, and the recorded weight is used as input variable for the controller, is characterized in that, in the event of uncontrolled addition of the basic components, the filling of the mixer is controlled by controlling the adjustable opening and the rotational frequency.

A further method according to the invention of operating a mixing installation according to the invention, in which the rotational frequency of the mixer is controllable, and the torque at the mixing tool is recorded and/or the filling of the mixer is monitored via the recording of the weight of the mix located in the mixer, and the recorded torque or weight respectively is used as input variable for the controller, is distinguished by the fact that, to protect against overload in the event of a limit value for the torque and/or the filling being exceeded, the size of the adjustable opening and/or the rotational frequency is controlled.

Another method according to the invention of operating a mixing installation according to the invention, in which the rotational frequency of the mixer is controllable, and the filling of the mixer is monitored via the recording of the weight of the mix located in the mixer, and the recorded weight is used as input variable for the controller, is characterized in that the rotational frequency and the filling or the filling ratio of the mixer are controlled in such a way that, even in the event of fluctuating feed conditions for the basic components, the average number of movements of the mix is constant on average.

Further embodiments follow from the dependent claims.

BRIEF DESCRIPTION OF THE DRAWINGS

The invention is to be explained in more detail below with reference to exemplary embodiments in connection with the drawing, in which.

WAYS OF IMPLEMENTING THE INVENTION

Figure 1:
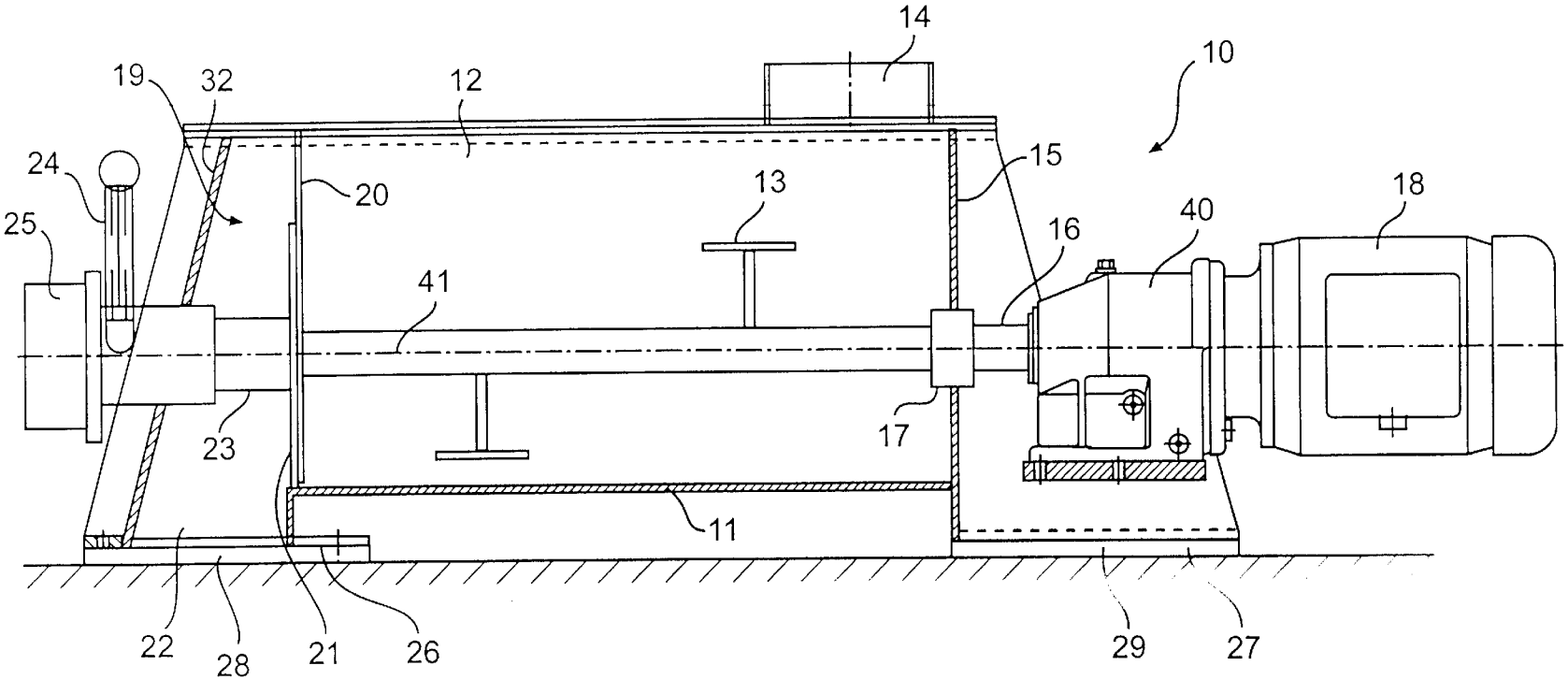
FIG. 1 shows a general view in longitudinal section of a preferred exemplary embodiment for a continuous mixer according to the invention.

A preferred exemplary embodiment for a continuous mixer according to the invention is shown in a general view in longitudinal section in FIG. 1. The continuous mixer 10 comprises a (trough-shaped) elongated mixing container 11, which encloses a mixing space 12, in which a mixing tool 13 (known per se) is arranged and mounted so as to be rotatable about an axis 41. The mixing container 11 is closed off on one side (the drive side) by an end wall 15. A drive consisting of a three-phase motor 18 and a downstream spur-gear unit 40 is arranged outside the end wall 15 and drives the mixing tool 13 via a shaft 16 extending through the end wall 15. The end wall 15 is sealed off in the region of the continuous shaft 16 via a shaft seal 17.

On the side opposite the end wall 15, the mixing container 11 merges into a discharge region 22 open at the bottom. The discharge region 22 in turn is closed off at the end face by a (sloping) end shield 32, which at the same time carries a flange bearing 25 for the rotatable mounting of the mixing tool 13. On the underside, the mixing container 11 has a plurality of machine feet 26, 27, with which it stands on the floor. Arranged between the machine feet 26, 27 and the floor are weighing cells 28, 29, by means of which the weight of the mixer 10 (including the mix located therein) can be measured.

The mixing container 11 is closed on the top side and is accessible from outside only through an inlet opening 14, through which the basic components, appropriately metered (e.g. by means of differential metering balances) are poured into the mixing space. The basic components are mixed with one another by the rotating mixing tool 13 and at the same time are transported in the mixing container in the axial direction from the inlet opening 14 to the discharge region 22, where they leave the mixer 10 by coming out at the bottom. On its way through the mixing space 12, the mix is moved repeatedly by the elements arranged on the periphery of the mixing tool 13 and rotating about the axis 41. The number of these movements of the mix depends on the rotational frequency of the mixing tool 13 and on the dwell time of the mix in the mixing space 12 and is a function of the product of rotational frequency and dwell time. If the rotational frequency is increased, the transport of the mix through the mixing space accelerates at the same time, so that the dwell time decreases. The change in the number of movements of the mix is then accordingly slight, since the reduced dwell time largely compensates for the increase in movements per unit of time.

Figure 2:
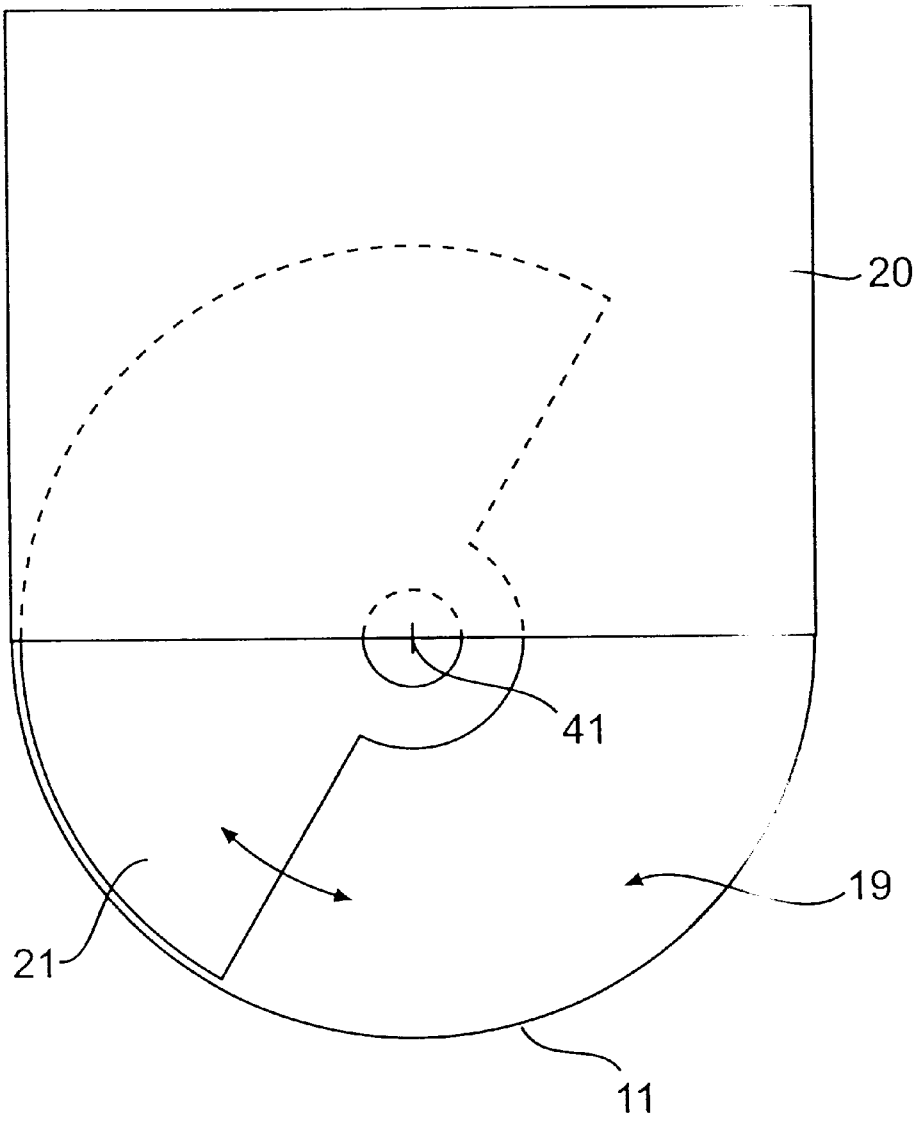
FIG. 2 shows a schematic view in axial direction of an exemplary embodiment for an adjustable opening in the form of a diaphragm having a fixed diaphragm part and an adjustable diaphragm part.

In order to achieve a change in the number of movements of the mix, the dwell time should therefore be changed, for example, while the rotational frequency stays the same. This is made possible by the adjustable discharge opening 19 according to the invention, this discharge opening 19 being arranged in the mixer 10 between the mixing space 12 and the discharge region 22 (FIGS. 1 and 2). The adjustable discharge opening 19 has the form of an adjustable diaphragm or an adjustable weir. Depending on the size of the opening, it prevents to a greater or lesser extent the discharge of the mix from the mixing space 12 into the discharge region 22 and thus leads to a more or less pronounced accumulation of the mix in the mixing space 12. If the discharge opening 19 is made smaller, the filling ratio of the mixer increases; on the other hand, if the discharge opening 19 is enlarged, the filling ratio decreases. Since the dwell time of the mix in the mixing space 12 is greater at a high filling ratio than at a small filling ratio, the dwell time of the mix and thus the number of movements of the mix can be influenced by the discharge opening 19.

In the example shown (FIGS. 1, 2), the adjustable discharge opening 19 consists of a fixed diaphragm part 20, which projects from above into the mixing space 12, and a diaphragm part 21 adjustable (rotatable) relative thereto. In FIG. 2, both diaphragm parts 20, 21 are shown in the direction of the axis 41 as viewed from the drive 18, 40. The adjustable discharge opening 19 is located in the bottom region of the diaphragm. In the example shown in FIG. 2, it has more than half its maximum size. If the adjustable diaphragm part 21 is rotated counterclockwise about the axis 41, the discharge opening 19 becomes smaller; if it is rotated clockwise, the discharge opening 19 becomes larger. In the example, the discharge opening can be completely closed. On the other hand, if it is partly or completely open, the mixer 10, without dismantling, can be completely emptied of the mix, since the discharge opening 19 is located in the region of the base of the mixing container 11.

The adjustable diaphragm part 21 is rotated from outside via an adjusting sleeve 23 arranged coaxially to the axis 41. In the example of FIG. 1, the adjustable discharge opening 19 is adjusted from outside via the adjusting sleeve 23 and an adjusting lever 24, which is designed for manual operation. However, the full effect of the adjustable discharge opening 19 is not obtained until the size of the opening is effected via a controllable drive, which can be included in an automatic control of the mixer or mixing operation. A hydraulically or electrically operable linearly acting actuating element which acts on the adjusting lever is conceivable as the drive. However, it is also possible to use a curved toothed ring instead of the adjusting lever, and this curved toothed ring is in engagement with the gearwheel of an electric drive.

Figure 3:
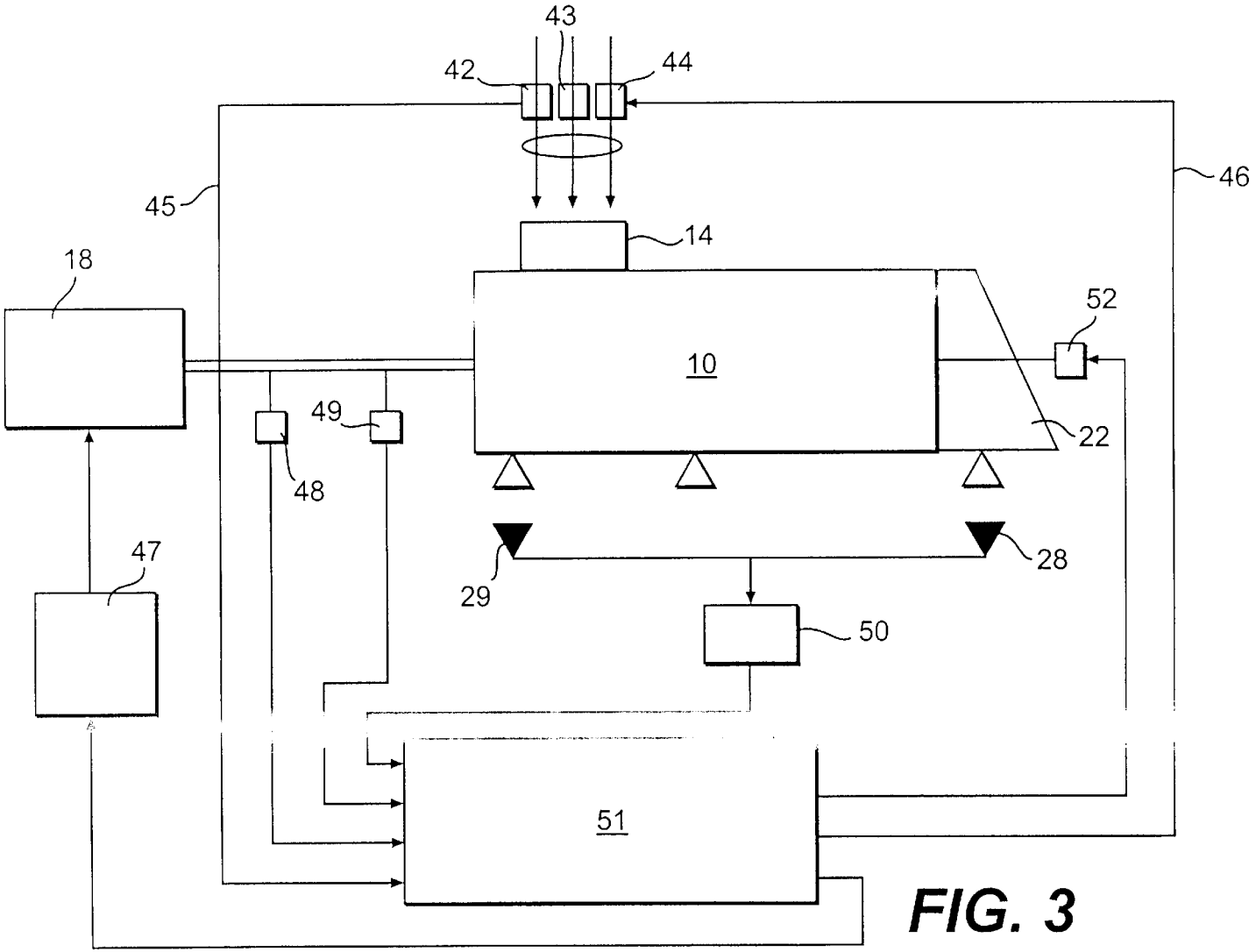
FIG. 3 shows the control scheme of a preferred exemplary embodiment of a mixing installation according to the invention with the mixer according to the invention.

The control scheme of a mixing installation equipped with a mixer according to FIGS. 1, 2 is shown in a preferred exemplary embodiment in FIG. 3. At the centre of the mixing installation is the continuous mixer 10, which is fed via the inlet opening 14 with, for example, three basic components (in accordance with the three arrows in FIG. 3). Each of the three basic components is metered via an allocated metering device 42, 43, 44, so that each component passes with a certain mass flow $dm_1/dt$, $dm_2/dt$ and $dm_3/dt$ into the mixer 10. The mass flows are transmitted as input variables via the signal line 45 to a controller 51, which on the output side controls the metering devices 42, 43, 44 via the control line 46. In addition to the mass flows, the measured values of a rotational-frequency sensor 48, which measures the rotational frequency of the mixing tool, and the measured values of a torque sensor 49, which measures the torque applied to the mixing tool, are transmitted to the controller 51. A further input variable of the controller 51 is the weight of the mixer 10 or of the mix, which is sensed via the weighing cells 28, 29 and processed in a weight-recording unit 50.

In addition to the metering devices 42, 43, 44, the position of the adjustable diaphragm part 21 or the size of the discharge opening 19 is controlled by the controller 51 via a drive 52 acting on the diaphragm part, and the rotational frequency of the three-phase motor 18 is controlled by the controller 51 via an upstream frequency converter 47. A further control possibility (not depicted in FIG. 3) consists in tilting the mixer 10 as a unit out of the horizontal position by an angle in order to increase the migration velocity of the mix in the mixing space (by lowering the discharge region) or to decrease said migration velocity (by raising the discharge region).

With a controlled mixing installation according to FIG. 3, various advantageous operating methods, inter alia, are possible:

In one case ("start-up cycle"), the adjustable opening 19 is first of all kept completely closed during the start-up of the mixing installation. After a specified set point of one or more of the input variables is reached, the controller 51 opens the adjustable opening 19 in a controlled manner to a size suitable for the steady operation of the mixing installation.

During the start-up of the continuous mixing installation, the mixer will not be in the steady state until after a time T1, i.e. the total mass flow of all the components fed in a metered manner to the mixer is equal to the mass flow which leaves the mixer. The weight recording permits the exact determination of the instant T1 at which the installation is in the steady state. Before this time, the product which leaves the mixer, for example, can be removed from the process. This is of interest in particular when the following process step requires a mass flow which is constant with respect to time.

In another case, in the event of fluctuating feed conditions, i.e. in the event of uncontrolled addition of the basic components, the filling of the mixer 10 is controlled by controlling the adjustable opening 19 and the rotational frequency of the three-phase motor 18. In this case, the filling is monitored by monitoring the weight of the mixer.

A further case relates to overload protection. The torque at the mixing tool 13 is recorded by means of the torque sensor 49 and/or the filling of the mixer 10 is monitored via the recording of the weight of the mix located in the mixer 10, and the recorded torque or weight respectively is used as input variable for the controller 51. To protect against overload in the event of a limit value for the torque (e.g. due to suddenly changing viscosity) and/or the filling being exceeded, the size of the adjustable opening 19 and the rotational frequency are controlled.

In another case, constant stressing of the product is to be achieved as far as possible. To this end, the rotational frequency and the filling or the filling ratio of the mixer 10 are controlled via the weight recording in such a way that, even in the event of fluctuating feed conditions for the basic components, the number of movements of the mix is constant on average.

All the operating methods may be carried out on their own here, but they may also be combined with one another in many different ways.

What is claimed is:

1. A continuous mixer, comprising:

an elongated mixing container, said container having an inlet opening at one end for feeding in basic components to be mixed;

said container enclosing a mixing space having a discharge region at the other end of the container for delivery of mixed product;

a mixing tool being positioned in the mixing container and being rotatable about an axis, said mixing tool being driven by a drive for mixing together the basic components fed into the inlet opening and for transporting the components to the discharge region;

an adjustable member being provided between the discharge region and the mixing space for defining an adjustable discharge opening between the discharge region and the mixing space;

a controllable drive being provided for adjusting said adjustable member to adjust the size of said discharge opening; and a controller that activates the controllable drive in accordance with at least one measured operating characteristic of said continuous mixer, with the at least one measured operating characteristic of the mixer being provided as an input variable to the controller.

2. Mixer according to claim 1, wherein the discharge opening is adjustable during the mixing operation.

3. Mixer according to claim 1, wherein the adjustable member is an adjustable diaphragm that separates the mixing space from the discharge region and the adjustable diaphragm includes a fixed diaphragm part and an adjustable diaphragm part adjustable relative thereto.

4. Mixer according to claim 3, wherein the fixed diaphragm part and the adjustable diaphragm part are arranged perpendicularly to the axis of the mixing tool, and the adjustable diaphragm part being arranged to rotate about the axis when being adjusted.

5. Mixer according to claim 4, wherein the mixing container includes an end shield at the end of the mixing container having a discharge region and the controllable drive includes a rotatably mounted adjusting sleeve, said adjusting sleeve being passed through the end shield and being sealed off from the mixing container.

6. Mixer according to claim 1, wherein the adjustable discharge opening is arranged in the bottom region of the mixing container.

7. Mixer according to claim 1, wherein the drive for driving said mixing tool has a variable rotational frequency, and said controller controls the rotational frequency of the drive in addition to activating the controllable drive in accordance with a measured operating characteristic of said continuous mixer.

8. Mixer according to claim 7, wherein the drive for driving the mixing tool comprises a three-phase motor with a frequency converter.

9. Mixer according to claim 1, further including means for recording and metering the mass flows of the basic components fed to the mixer through the inlet opening, the measured mass flows being used as input variables for the controller, and the controller controlling the metering of the basic components.

10. A method of operating a mixer according to claim 1, wherein during the start-up of the mixer, the adjustable discharge opening is first kept completely closed, and after a specified set point of at least one input variable is reached, the controller activates the controllable drive to open the adjustable opening in a controlled manner to a size at which the total mass flow of all basic components fed into the mixer is substantially equal to the total mass flow leaving the mixer.

11. Mixer according to claim 1, further including at least one of a rotational-frequency sensor for measuring the rotational frequency of the mixing tool and a torque sensor for measuring the torque acting on the mixing tool, and wherein measured values delivered from said at least one sensor are used as input variables for the controller.

12. Method of operating a mixer according to claim 11, wherein the mixer further includes means for recording the weight of the mixed product located in the mixter, said method including the step of protecting against overload in the event at least one of a limit value for the torque and limit value for the weight of the mixed product located in the mixer are exceeded, then at least one of the size of the adjustable discharge opening and the rotational frequency of the mixing tool is controlled.

13. Method of operating a mixer according to claim 11, wherein the mixer further includes means for recording the weight of the mixed product located in the mixer, said method including the step of controlling the rotational frequency of the mixing tool and the weight of the mixed product located in the mixer in such a way that, even in the event of fluctuating feed conditions for the basic components, the number of average movements of the mix is constant on average.

14. Mixer according to claim 1, further including means for recording the weight of the mixed product located in the mixer, and the recorded weight being used as an input variable for the controller.

15. Mixer according to claim 14, wherein the means for recording the weight of the mixed product comprises at least one weighing cell attached to a weight-recording unit and the mixer stands on the at least one weighing cell.

16. Method of operating a mixer according to claim 14, wherein the rotational frequency of the mixer is controllable, and the filling of the mixer is monitored via the recording of the weight of the mixed product located in the mixer, and the recorded weight is used as an input variable for the controller, and wherein the filling of the mixer is controlled by controlling the adjustable discharge opening and controlling the rotational frequency of the mixer.

* * * * *